US011684228B2

(12) United States Patent
Tang et al.

(10) Patent No.: US 11,684,228 B2
(45) Date of Patent: Jun. 27, 2023

(54) CYCLONIC SEPARATING DEVICE AND SURFACE CLEANING DEVICE

(71) Applicants: Beijing Shunzao Technology Co., Ltd., Beijing (CN); BEIJING XIAOMI MOBILE SOFTWARE CO., LTD., Beijing (CN)

(72) Inventors: Cheng Tang, Beijing (CN); Fei Duan, Beijing (CN); Liang Zhong, Beijing (CN); Peiheng Zhu, Beijing (CN); Yuan Lv, Beijing (CN)

(73) Assignees: Beijing Shunzao Technology Co., Ltd., Beijing (CN); BEIJING XIAOMI MOBILE SOFTWARE CO., LTD., Beijing (CN)

( * ) Notice: Subject to any disclaimer, the term of this patent is extended or adjusted under 35 U.S.C. 154(b) by 58 days.

(21) Appl. No.: 17/567,026

(22) Filed: Dec. 31, 2021

(65) Prior Publication Data

US 2022/0287525 A1 Sep. 15, 2022

(30) Foreign Application Priority Data

Mar. 11, 2021 (CN) ..... 202120625460.9

(51) Int. Cl.
*A47L 9/16* (2006.01)
*A47L 9/32* (2006.01)

(52) U.S. Cl.
CPC ..... *A47L 9/1641* (2013.01); *A47L 9/1608* (2013.01); *A47L 9/322* (2013.01)

(58) Field of Classification Search
CPC ..... A47L 9/1641; A47L 9/1608; A47L 9/322; A47L 5/24; A47L 9/1633; A47L 9/1683; A47L 9/1625
See application file for complete search history.

(56) References Cited

U.S. PATENT DOCUMENTS

| | | | | |
|---|---|---|---|---|
| 4,956,090 | A * | 9/1990 | Robinson | D21D 5/24 210/512.1 |
| 10,390,670 | B2 * | 8/2019 | Robinson | A47L 5/24 |
| 2006/0230723 | A1 * | 10/2006 | Kim | A47L 9/1641 55/345 |
| 2007/0084160 | A1 * | 4/2007 | Kim | A47L 9/1666 55/345 |
| 2007/0144116 | A1 * | 6/2007 | Hong | A47L 9/1658 55/345 |

(Continued)

*Primary Examiner* — Dung H Bui
(74) *Attorney, Agent, or Firm* — Cozen O'Connor

(57) ABSTRACT

A cyclonic separating device includes first and second cyclonic separating units. The first cyclonic separating unit is fitted over the second cyclonic separating unit. The second cyclonic separating unit includes first cyclones and second cyclones respectively arranged in a ring shape. Dust falling ends of the first cyclones define an accommodation space therebetween. The second cyclones partially extend into the accommodation space. Each first cyclone comprises first, second and third cone sections, each of which has a cone structure; airflow sucked in the first cyclones is sequentially separated by the first, second and third cone sections, and dust in the airflow is discharged from the third cone section; a central axis of the first cone section is parallel to a longitudinal axis of the dust cup; and an angle between a central axis of the second cone section and a central axis of the third cone section is 5°-20°.

15 Claims, 2 Drawing Sheets

(56) References Cited

U.S. PATENT DOCUMENTS

| | | | | |
|---|---|---|---|---|
| 2008/0172994 | A1* | 7/2008 | Courtney | B01D 45/16 55/385.3 |
| 2009/0100633 | A1* | 4/2009 | Bates | A47L 9/1633 15/347 |
| 2009/0100810 | A1* | 4/2009 | Smith | A47L 9/1625 55/346 |
| 2009/0113861 | A1* | 5/2009 | Seo | A47L 9/1658 55/429 |
| 2010/0139033 | A1* | 6/2010 | Makarov | A47L 9/1625 15/353 |
| 2010/0180557 | A1* | 7/2010 | Kaidalov | B01J 8/0055 55/345 |
| 2010/0218338 | A1* | 9/2010 | McLeod | B04C 5/26 55/346 |
| 2011/0016661 | A1* | 1/2011 | Dyson | A47L 9/1641 96/57 |
| 2012/0272474 | A1* | 11/2012 | Follows | A47L 9/1641 15/347 |
| 2013/0091813 | A1* | 4/2013 | Smith | A47L 9/1625 55/342.2 |
| 2013/0305483 | A1* | 11/2013 | Dyson | A47L 9/1616 15/353 |
| 2014/0090341 | A1* | 4/2014 | Chen | A47L 9/1625 55/346 |
| 2014/0137364 | A1* | 5/2014 | Stickney | A47L 5/24 15/347 |
| 2018/0368638 | A1* | 12/2018 | Demaus | A47L 9/1691 |
| 2021/0212537 | A1* | 7/2021 | Cho | A47L 9/1625 |

* cited by examiner

CYCLONIC SEPARATING DEVICE AND SURFACE CLEANING DEVICE

CROSS-REFERENCE TO RELATED APPLICATION

This application claims priority to and benefits of Chinese Patent Application Serial No. 202120625460.9, filed on Mar. 11, 2021, the entire content of which is incorporated herein by reference.

TECHNICAL FIELD

The present disclosure relates to the field of vacuum cleaners, and more particularly, to a cyclonic separating device.

BACKGROUND

Vacuum cleaners are commonly used cleaning devices in daily life, and can generate strong suction force, to take in foreign matter and dust accumulated on carpets, floors or other surfaces into a dust collecting cup.

Vacuum cleaners include a body, and a motor and a fan unit located in the body. The body is connected with a cyclonic separating device. The cyclonic separating device is typically used to separate dirt in airflow. The cyclonic separating device defines a dusty-air inlet. When the motor and the fan unit in the body are in operation, the dirt is sucked into the cyclonic separating device through the dusty-air inlet, and cleaned air then leaves from the cyclonic separating device by the motor and the fan unit.

SUMMARY

The present disclosure provides a cyclonic separating device, including a dust cup; and a first cyclonic separating unit and a second cyclonic separating unit both provided in the dust cup. The first cyclonic separating unit is fitted over an outside of the second cyclonic separating unit. The second cyclonic separating unit includes a first cyclone separator group and a second cyclone separator group. The first cyclone separator group includes a plurality of first cyclones arranged in a ring shape, and dust falling ends of the plurality of first cyclones define an accommodation space therebetween. The second cyclone separator group includes a plurality of second cyclones arranged in a ring shape, and each second cyclone partially extends into the accommodation space. Each of the first cyclones and the second cyclones has a multi-section cone structure; each first cyclone comprises a first cone section, a second cone section and a third cone section sequentially connected; airflow sucked in each first cyclone is sequentially separated by the first cone section, the second cone section and the third cone section, and dust in the airflow is discharged from the third cone section; a central axis of the first cone section is parallel to a longitudinal axis of the dust cup; and an angle between the central axis of the second cone section and the central axis of the third cone section is 5°-20°.

The present disclosure further provides a surface cleaning device, including a suction pipe; a cyclonic separating device in communication with the suction pipe; an airflow generator configured to generate airflow flowing along the suction pipe; a power source configured to power the airflow generator; and a handle provided between the cyclonic separating device and the power source and configured for gripping by a user. The cyclonic separating device includes a dust cup; and a first cyclonic separating unit and a second cyclonic separating unit both provided in the dust cup. The first cyclonic separating unit is fitted over an outside of the second cyclonic separating unit. The second cyclonic separating unit includes a first cyclone separator group and a second cyclone separator group. The first cyclone separator group includes a plurality of first cyclones arranged in a ring shape, and dust falling ends of the plurality of first cyclones define an accommodation space therebetween. The second cyclone separator group includes a plurality of second cyclones arranged in a ring shape, and each second cyclone partially extends into the accommodation space. Each of the first cyclones and the second cyclones has a multi-section cone structure; each first cyclone comprises a first cone section, a second cone section and a third cone section sequentially connected; airflow sucked in each first cyclone is sequentially separated by the first cone section, the second cone section and the third cone section, and dust in the airflow is discharged from the third cone section; a central axis of the first cone section is parallel to a longitudinal axis of the dust cup; and an angle between the central axis of the second cone section and the central axis of the third cone section is 5°-20°.

DETAILED DESCRIPTION

In order to better understand the above-described technical solutions, exemplary embodiments of the present disclosure will be described in detail with reference to the accompanying drawings. Although exemplary embodiments of the present disclosure are illustrated in the accompanying drawings, it should be understood that, the present disclosure can be realized in various forms and should not be limited by the embodiments set forth herein. On the contrary, provision of the embodiments enables the present disclosure to be understood more clearly and thoroughly, and enables the scope of the present disclosure to be fully conveyed to those skilled in the art.

In the existing cyclonic separating devices, two cyclonic separation layers are stacked sequentially in an outer frame, each cyclonic separation layer includes a plurality of cyclones, and conical inlets of the plurality of cyclones are oriented towards the same side. Conical inlets of the lower cyclonic separation layer extend into space of the upper cyclonic separation layer. However, since the structure of cyclones of the cyclonic separation layers is not compact, more cyclones cannot be arranged in limited space, leading to low cyclonic separation efficiency.

Figure 1:
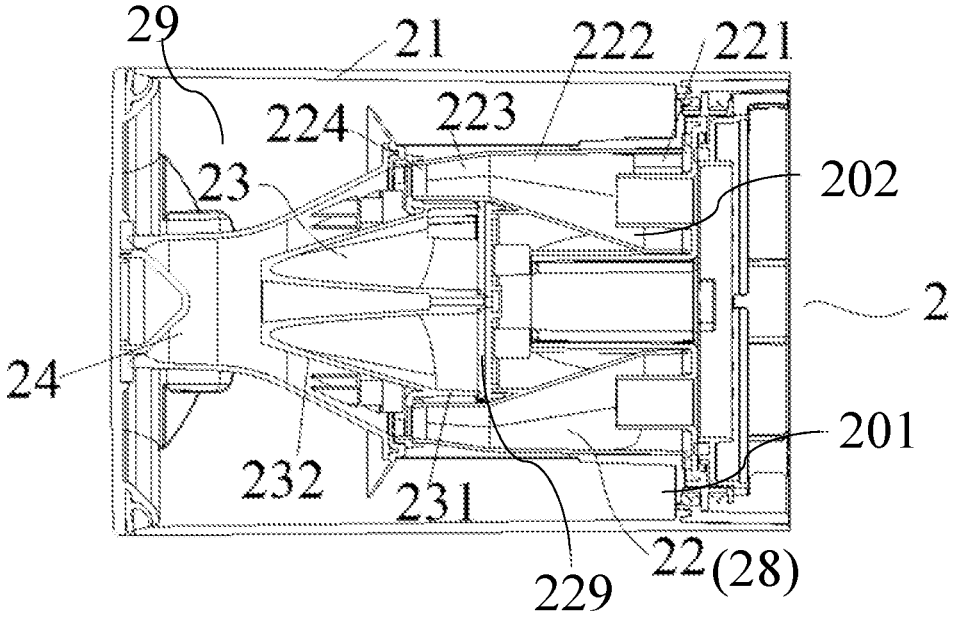
FIG. 1 is a front sectional view of a cyclonic separating device according to an embodiment of the present disclosure.
Figure 2:
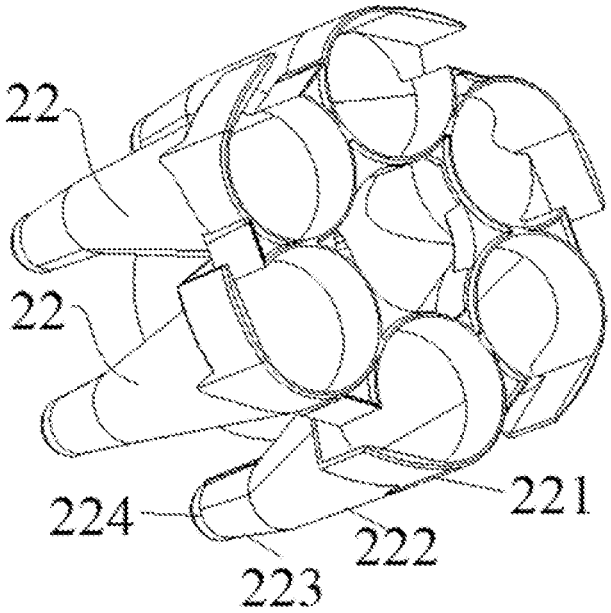
FIG. 2 is a schematic view of the first cyclone separator group in FIG. 1.

As illustrated in FIGS. 1 and 2, the present embodiment provides a cyclonic separating device 2, which includes a dust cup 21 and a first cyclonic separating unit 201 and a second cyclonic separating unit 202 that are provided in the dust cup 21. The first cyclonic separating unit 201 is fitted over an outside of the second cyclonic separating unit 202. The cyclonic separating device 2 in the present embodiment is divided into two-stage separation, and airflow enters the first cyclonic separating unit 201 for first separation, and after the first separation the airflow enters the second cyclonic separating unit 202 for second separation.

As illustrated in FIG. 1, the second cyclonic separating unit 202 includes a first cyclone separator group 28 and a second cyclone separator group 29. The first cyclone separator group 28 includes a plurality of first cyclones 22, the plurality of first cyclones 22 are ranged in a ring shape, and an accommodation space 229 is defined between dust falling ends of the plurality of first cyclones 22. The second cyclone separator group 29 includes a plurality of second cyclones 23, the plurality of second cyclones 23 are arranged in a ring shape, and each second cyclone 23 partially extend into the accommodation space 229. Each of the first cyclones 22 and the second cyclones 23 has a multi-section cone structure.

In the cyclonic separating device 2 provided by the present embodiment, the first cyclones 22 and the second cyclones 23 of the first cyclone separator group 28 and the second cyclone separator group 29 are configured as the multi-section cone structure, such that arrangement of the first cyclone separator group 28 and the second cyclone separator group 29 fully utilize space, the cyclonic separating device 2 has a compact structure, and the first cyclone separator group 28 and the second cyclone separator group 29 enable more cyclones to be arranged in the limited space, to promote separation efficiency of the cyclonic separating device 2.

In order to promote air inlet efficiency of each cyclone, each cyclone in the first cyclone separator group 28 may be arranged in a step shape, and thus an air inlet of each cyclone directly faces an air inlet of the cyclonic separating device 2. Similarly, each cyclone in the second cyclone separator group 29 may also be arranged in a step shape, to promote air inlet efficiency of the cyclones.

In at least one embodiment, as shown in FIG. 1 and FIG. 2, the first cyclone 22 includes a first cone section 221, second cone section 222 and a third cone section 223 that are sequentially connected. Each of the first cone section 221, the second cone section 222 and the third cone section 223 has a cone structure. During airflow separation, airflow sucked in each first cyclone 22 is sequentially separated through the first cone section 221, the second cone section 222 and the third cone section 223, dust in the airflow is discharged from the third cone section 223 and falls into a dust falling nozzle 24. In a practical application, a central axis of the first cone section 221 is parallel to a longitudinal axis of the dust cup 21, and an angle between a central axis of the second cone section and a central axis of the third cone section is 5°-20°. In the present embodiment, the angle between the central axis of the second cone section and the central axis of the third cone section refers to an acute angle formed between the two central axes.

In some embodiments, the central axis of the second cone section 222 is deflected outwards relative to the longitudinal axis of the dust cup 21, and the central axis of the third cone section 223 is deflected inwards relative to the longitudinal axis of the dust cup 21. In this way, the second cyclone separator group 29 can partially extend into the accommodation space 229 of the first cyclone separator group 28 enclosed by the plurality of first cyclones 22 conveniently, to make space layout more reasonable.

In some embodiments, an angle of the central axis of the second cone section 222 deflected outwards relative to the longitudinal axis of the dust cup 21 is 5°-10.6°. An angle of the central axis of the third cone section 223 deflected inwards relative to the longitudinal axis of the dust cup 21 is 2.3°-6.3°. In some embodiments, the angle of the central axis of the second cone section 222 deflected outwards relative to the longitudinal axis of the dust cup 21 is 7.3°-8.3°. The angle of the central axis of the third cone section 223 deflected inwards relative to longitudinal axis of the dust cup 21 is 3.8°-4.8°. In the present embodiment, the angle of the central axis of the second cone section 222 deflected outwards relative to the longitudinal axis of the dust cup 21 is 7.8°, and the angle of the central axis of the third cone section 223 deflected inwards relative to longitudinal axis of the dust cup 21 is 4.3°.

It should be noted that, in the present embodiment, the central axis refers to a connecting line between centers of plane circles at two ends of each cone section, and the longitudinal axis of the dust cup 21 is a horizontal line.

In one aspect, the first cyclones 22 may also include a fourth cone section 224, the fourth cone section 224 is connected to the third cone section 223, and a central axis of the fourth cone section 224 is parallel to the longitudinal axis of the dust cup 21. In this way, the fine dust separated from the airflow can fall into the dust falling nozzle 24 conveniently.

In the present embodiment, each second cyclone 23 includes a fifth cone section 231 and a sixth cone section 232 sequentially connected. Each of the fifth cone section 231 and the sixth cone section 232 has a cone structure. During airflow separation, airflow sucked into each second cyclone 23 is sequentially separated through the fifth cone section 231 and the sixth cone section 232, and the dust in the airflow is discharged from the sixth cone section 232 and falls into the dust falling nozzle 24. In a practical application, a central axis of the fifth cone section 231 is parallel to the longitudinal axis of the dust cup 21, and a central axis of the sixth cone section 232 is deflected inwards relative to longitudinal axis of the dust cup 21.

In some embodiments, an angle of the central axis of the sixth cone section 232 deflected inwards relative to the longitudinal axis of the dust cup 21 is 5°-9.4°, and in some embodiments, the angle of the central axis of the sixth cone section 232 deflected inwards relative to the longitudinal axis of the dust cup 21 is 6.7°-7.7°. In the present embodiment, the angle of the central axis of the sixth cone section 232 deflected inwards relative to the longitudinal axis of the dust cup 21 is 7.2°.

An operation process of the cyclonic separating device 2 is as follows:

When the cyclonic separating device 2 is in operation, airflow with fine dust enters the first cyclonic separating unit 201 for the first separation, the airflow after the first separation then enters the second cyclonic separating unit 202 for the second separation; during the second airflow separation, the airflow sucked in each first cyclones 22 is sequentially separated by the first cone section 221, the second cone section 222 and the third cone section 223, the dust in the airflow is discharged from the third cone section 223 and falls into the dust falling nozzle 24; the airflow sucked in each second cyclone 23 is sequentially separated by the fifth cone section 231 and the sixth cone section 232, and the dust in the airflow is discharged from the sixth cone section 232 and falls into the dust falling nozzle 24.

Figure 3:
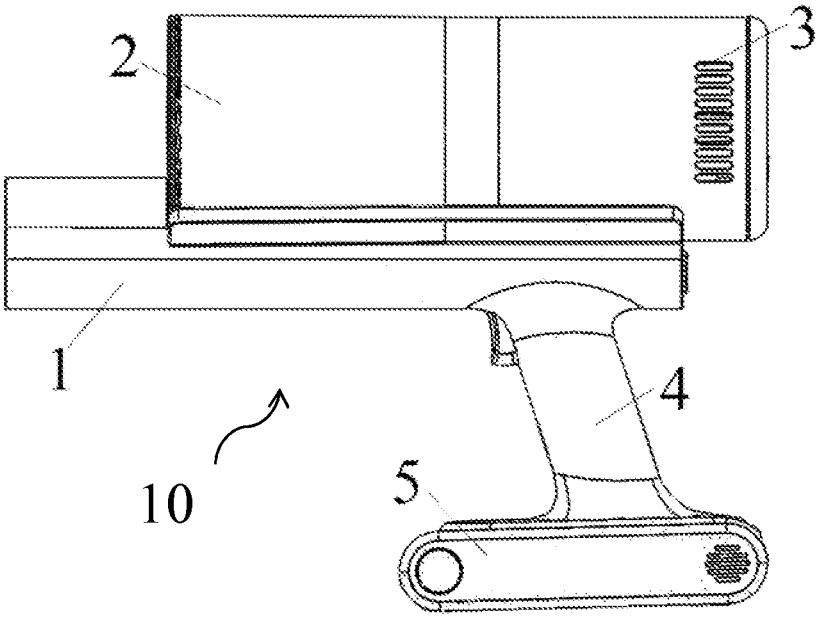
FIG. 3 is a schematic view of a surface cleaning device according to an embodiment of the present disclosure.

As illustrated in FIG. 3, the present embodiment provides a surface cleaning device 10 including a cyclonic separating device 2 according to the above embodiment. The surface cleaning device 10 further includes a suction pipe 1, an airflow generator 3, a handle 4 and a power source 5 configured to power the airflow generator 3. The airflow generator 3 is configured to generate airflow flowing along the suction pipe 1, and the cyclonic separating device 2 is arranged to be in communication with the suction pipe 1, to separate dirt and dust from the airflow. The handle 4 is provided between the cyclonic separating device 2 and the power source 5, and the handle 4 is arranged to be suitable for gripping by a hand of a user.

In the present disclosure, unless specified or limited otherwise, the terms "mounted," "connected," "communicated," "fixed" and the like are used broadly, and may be, for example, fixed connections, detachable connections, or integral connections; may also be mechanical or electrical connections; may also be direct connections or indirect connections via intervening structures; may also be inner communications or interactions of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Additionally, without conflict, a person skilled in the art can combine different embodiments or examples of the features of different embodiments or example described in this specification.

Although embodiments of the present disclosure have been shown and described, it would be appreciated by those skilled in the art that the above embodiments are exemplary and cannot be construed to limit the present disclosure, and changes, alternatives, and modifications can be made in the embodiments within the scope of the present disclosure.

What is claimed is:

1. A cyclonic separating device, comprising:

a dust cup;

a first cyclonic separating unit; and a second cyclonic separating unit, wherein airflow enters the first cyclonic separating unit for first separation, and after the first separation the airflow enters the second cyclonic separating unit for second separation, wherein both the first cyclonic separating unit and the second cyclonic separating unit are located in the dust cup, the first cyclonic separating unit being fitted over an outside of the second cyclonic separating unit, the second cyclonic separating unit comprising a first cyclone separator group and a second cyclone separator group, the first cyclone separator group comprising a plurality of first cyclones arranged in a ring shape, dust falling ends of the plurality of first cyclones defining an accommodation space therebetween, the second cyclone separator group comprising a plurality of second cyclones arranged in a ring shape, each second cyclone partially extending into the accommodation space, wherein each of the first cyclones and the second cyclones has a multi-section cone structure, each first cyclone comprises a first cone section, a second cone section and a third cone section sequentially connected; airflow sucked in each first cyclone is sequentially separated by the first cone section, the second cone section and the third cone section, and dust in the airflow is discharged from the third cone section;

a central axis of the first cone section is parallel to a longitudinal axis of the dust cup; and an angle between a central axis of the second cone section and a central axis of the third cone section is 5°-20°, wherein the central axis of the second cone section is deflected outwards relative to the longitudinal axis of the dust cup; and the central axis of the third cone section is deflected inwards relative to the longitudinal axis of the dust cup, wherein an angle of the central axis of the second cone section deflected outwards relative to the longitudinal axis of the dust cup is 5°-10.6°, and wherein an angle of the central axis of the third cone section deflected inwards relative to the longitudinal axis of the dust cup is 2.3°-6.3°.

2. The cyclonic separating device according to claim 1, wherein the angle of the central axis of the second cone section deflected outwards relative to the longitudinal axis of the dust cup is 7.3°-8.3°.

3. The cyclonic separating device according to claim 2, wherein the angle of the central axis of the second cone section deflected outwards relative to the longitudinal axis of the dust cup is 7.8°.

4. The cyclonic separating device according to claim 1, wherein the angle of the central axis of the third cone section deflected inwards relative to the longitudinal axis of the dust cup is 3.8°-4.8°.

5. The cyclonic separating device according to claim 4, wherein the angle of the central axis of the third cone section deflected inwards relative to the longitudinal axis of the dust cup is 4.3°.

6. The cyclonic separating device according to claim 1, wherein each first cyclone further comprises a fourth cone section connected to the third cone section; and a central axis of the fourth cone section is parallel to the longitudinal axis of the dust cup.

7. The cyclonic separating device according to claim 1, wherein each second cyclone comprises a fifth cone section and a sixth cone section connected sequentially;

airflow sucked in each second cyclone is sequentially separated by the fifth cone section and the sixth cone section, and dust in the airflow is discharged from the sixth cone section;

a central axis of the fifth cone section is parallel to the longitudinal axis of the dust cup; and a central axis of the sixth cone section is deflected inwards relative to the longitudinal axis of the dust cup.

8. The cyclonic separating device according to claim 7, wherein an angle of the central axis of the sixth cone section deflected inwards relative to the longitudinal axis of the dust cup is 5°-9.4°.

9. The cyclonic separating device according to claim 8, wherein the angle of the central axis of the sixth cone section deflected inwards relative to the longitudinal axis of the dust cup is 6.7°-7.7°.

10. The cyclonic separating device according to claim 9, wherein the angle of the central axis of the sixth cone section deflected inwards relative to the longitudinal axis of the dust cup is 7.2°.

11. The cyclonic separating device according to claim 1, wherein each cyclone in the first cyclone separator group is arranged in a step shape, and an air inlet of each cyclone directly faces an air inlet of the cyclonic separating device.

12. The cyclonic separating device according to claim 1, wherein each cyclone in the second cyclone separator group is arranged in a step shape.

13. A surface cleaning device, comprising:

a suction pipe;

a cyclonic separating device in communication with the suction pipe, the cyclonic separating device comprising:

a dust cup, a first cyclonic separating unit, and a second cyclonic separating unit, wherein both the first cyclonic separating unit and the second cyclonic separating unit are located in the dust cup, the first cyclonic separating unit being fitted over an outside of the second cyclonic separating unit so that airflow enters the first cyclonic separating unit for first separation, and after the first separation the airflow enters the second cyclonic separating unit for second separation, the second cyclonic separating unit comprising a first cyclone separator group and a second cyclone separator group, the first cyclone separator group comprising a plurality of first cyclones arranged in a ring shape, dust falling ends of the plurality of first cyclones defining an accommodation space therebetween, the second cyclone separator group comprising a plurality of second cyclones arranged in a ring shape, each second cyclone partially extending into the accommodation space, an airflow generator configured to generate airflow flowing along the suction pipe;

a power source configured to power the airflow generator; and a handle provided between the cyclonic separating device and the power source and configured for gripping by a user, wherein each of the first cyclones and the second cyclones has a multi-section cone structure; each first cyclone comprises a first cone section, a second cone section and a third cone section sequentially connected; airflow sucked in each first cyclone is sequentially separated by the first cone section, the second cone section and the third cone section, and dust in the airflow is discharged from the third cone section; a central axis of the first cone section is parallel to a longitudinal axis of the dust cup; and an angle between a central axis of the second cone section and a central axis of the third cone section is 5°-20°, wherein the central axis of the second cone section is deflected outwards relative to the longitudinal axis of the dust cup; and the central axis of the third cone section is deflected inwards relative to the longitudinal axis of the dust cup, wherein an angle of the central axis of the second cone section deflected outwards relative to the longitudinal axis of the dust cup is 5°-10.6°, and wherein an angle of the central axis of the third cone section deflected inwards relative to the longitudinal axis of the dust cup is 2.3°-6.3°.

14. The surface cleaning device according to claim 13, wherein the angle of the central axis of the second cone section deflected outwards relative to the longitudinal axis of the dust cup is 7.3°-8.3°.

15. The surface cleaning device according to claim 14, wherein the angle of the central axis of the second cone section deflected outwards relative to the longitudinal axis of the dust cup is 7.8°.

* * * * *